US005507913A

United States Patent [19]

Murphy et al.

[11] Patent Number: 5,507,913

[45] Date of Patent: Apr. 16, 1996

[54] SOLVENT RECOVERY IN PULP BLEACHING WITH OZONE

[75] Inventors: Thomas H. Murphy, Surrey; Robert G. Norris, Ladysmith, both of Canada

[73] Assignee: MacMillan Bloedel Limited, Vancouver, Canada

[21] Appl. No.: 352,762

[22] Filed: Dec. 5, 1994

Related U.S. Application Data

[63] Continuation-in-part of Ser. No. 136,184, Oct. 15, 1993, abandoned.

[51] Int. Cl.[6] ..... D21C 9/153

[52] U.S. Cl. ..... 162/41; 162/65; 162/77

[58] Field of Search ..... 162/29, 41, 65, 162/65 B, 77, 90

[56] References Cited

U.S. PATENT DOCUMENTS 4,100,016 7/1978 Diebold et al. ..... 162/16

FOREIGN PATENT DOCUMENTS 90403 1/1977 Japan .
49107 5/1978 Japan .
9315261 8/1993 WIPO .

*Primary Examiner*—David L. Lacey
*Assistant Examiner*—Dean T. Nguyen
*Attorney, Agent, or Firm*—C. A. Rowley

[57] ABSTRACT

A process for bleaching pulp by impregnating the pulp with an aqueous organic solvent medium and then bleaching in an ozone stage (Z stage) to form a bleached pulp characterized in that organic solvent in the organic solvent medium accompanying the pulp through the ozone stage is neutralized and stripped from the bleached pulp leaving the ozone stage and the separated organic solvent is recovered for reuse.

10 Claims, 4 Drawing Sheets

SOLVENT RECOVERY IN PULP BLEACHING WITH OZONE

This application is a continuation-in-part of application Ser. No. 08/136,184 filed Oct. 15, 1993,now abandoned.

FIELD OF THE INVENTION

The present invention relates to the recovery of organic solvents, more particularly, the present invention relates to the recovery of organic solvents from an ozone bleached pulp.

BACKGROUND OF THE PRESENT INVENTION

The concept of bleaching pulp by carrying the pulp in organic solvents and ozone bleaching (Z stage) in the presence of an organic solvent has been discussed by many. Attention is directed to the paper "The Use of Ozone in Bleaching Pulps" by Liebergott et al., 1991 Pulping Conference, TAPPI Proceedings, pp 1–23, wherein a number of different ozone pulping processes are discussed in a review of the literature that describes various additives that have been suggested and/or used as additives to the pulp to function as a protector or the like during the Z stage. Some interesting disclosures discussing the use of organic solvents in the ozone bleaching stage are contained in Report No. 53, Chapter 2, supplement to Report Nos. 53 and 54 by Rothenberg et al. all by the Empire State Paper Research Associates Inc. dated 1971 (the supplement to Report No. 53 is dated Apr. 12, 1971 and Report No. 54, Oct. 1, 1971). These reports disclose various protectors for the pulp including organic solvents such as ethanol and methanol used as the liquid medium in the Z stage.

Japanese patent 90,403 issued Jan. 17, 1977 to Ueshima et al. provides a further discussion on the use of methanol as a protector during ozone bleaching as does the paper "Effect of Cellulose Protectors on Ozone Bleaching of Kraft Pulp" by Kamishima et al. in the Journal of Japanese Technical Association of the Pulp and Paper Industry, Vol 31, No. 9, September 1977, pp 62–70, which also discusses other cellulose protectors.

Japanese patent 49,107 issued May 4, 1978 to Ueshima et al. is the only patent that includes a discussion of recovery of methanol. Ueshima recognizes methanol as a byproduct of the digestion process. In the disclosed system recovered methanol from the cooking or digestion process is added to the pulp prior to a Z stage and then methanol is washed from the bleached pulp and by counter-current washing, washer filtrate containing the methanol from the Z stage finds it way back through the process and is eventually included with black liquor from the digestion stage for methanol separation. This methanol from the Z stage plus the methanol generated during the pulping process is all separated by washing from the pulp (prior to the ozone stage). Methanol is also recovered from the relief and blow gases generated during pulping and this recovered methanol is returned to the bleaching process, i.e. to impregnate the pulp prior to the Z stage.

More recent processes to bleach pulp with ozone in the presence of an aqueous organic solvent, in particular, methanol or ethanol and that obtained results that show very significant improvement over what has been previously accomplished are disclosed in U.S. patent application Ser. No. 08/056,496, commonly assigned, filed May 3, 1993, Solinas et al.

BRIEF DESCRIPTION OF THE PRESENT INVENTION

It is an object of the present invention to provide a recovery system for recovering organic solvent used in an ozone bleaching process as the organic compound in the aqueous medium surrounding the pulp during the Z stage.

Broadly, the present invention relates to a process of recovering an organic solvent from a pulp mass containing an aqueous solvent of said organic medium characterized in that said organic solvent contained in said aqueous organic medium accompanying said bleached pulp is stripped from said pulp by application of heat to evaporate said solvent and provide a separated organic solvent liquor thereby to recover said organic solvent liquor and provide an aqueous suspension of pulp substantially free from said organic solvent.

Preferably, said heat is applied by passing steam in through said pulp.

Broadly, the present invention also relates to a process of bleaching pulp in an aqueous organic solvent and recovering the solvent comprising impregnating said pulp with said aqueous organic solvent medium in an impregnation stage to form an impregnated pulp, bleaching said impregnated pulp with ozone in an ozone bleaching stage (Z stage) to form a bleached pulp characterized in that said organic solvent contained in said aqueous organic medium accompanying said bleached pulp is stripped from said bleached pulp by application of heat to evaporate said solvent and provide a separated organic solvent liquor thereby to recover said organic solvent liquor.

Preferably, the pH of the ozonated pulp will be neutralized to a pH within a range of 6 to 10 before the solvent is stripped from the pulp. More preferably, the pulp will be neutralized to a pH between 7 and 9 before methanol or organic solvent stripping.

Preferably, said organic solvent liquor is returned to said impregnation stage.

Preferably, said separated organic solvent liquor is further concentrated and is returned to said impregnation stage as a further concentrated liquor.

Preferably, said impregnation stage will include diluting said pulp in said aqueous organic solvent medium, separating excess of said medium diluting said pulp in said impregnation stage to provide said impregnated pulp free of excess of said aqueous organic solvent medium.

Preferably, said excess of said aqueous organic solvent medium is distilled to separate said organic solvent from said excess aqueous organic solvent medium thereby provide recovered excess solvent recovered from said excess organic solvent medium returning said recovered solvent to said impregnation stage.

Preferably, said application of heat will comprise passing steam in counter-current through said bleached pulp containing said aqueous organic solvent.

Preferably, said organic solvent will be selected from ethanol or methanol.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
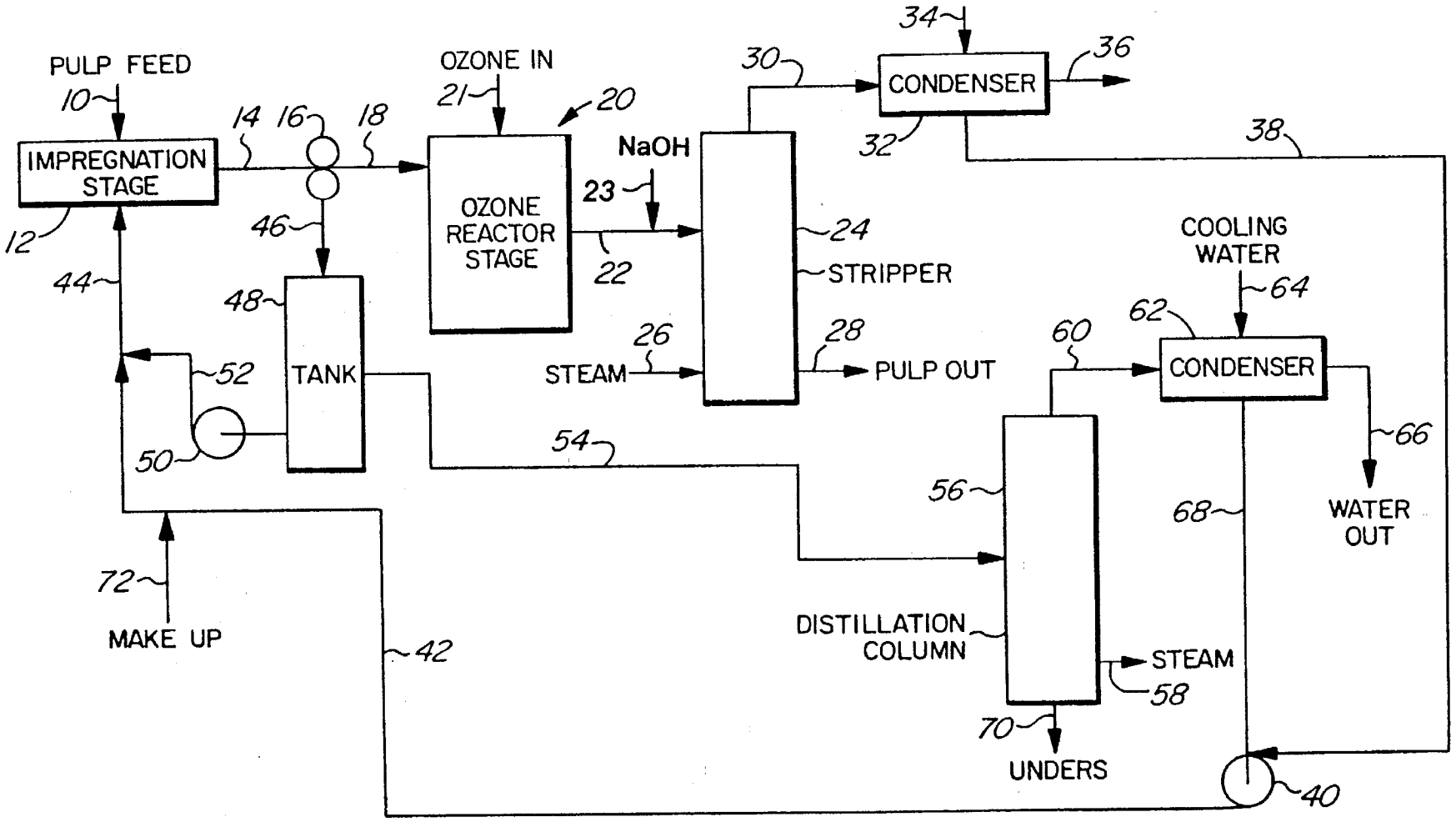
FIG. 1 is a schematic illustration of a bleaching process incorporating the present invention.

FIG. 1 illustrates a pulp bleaching system incorporating the present invention. As illustrated, pulp enters the system as indicated at 10 and is diluted in an impregnation stage 12 using a suitable aqueous organic solvent medium preferably an aqueous medium containing alcohol particularly methanol or ethanol medium generally to a consistency of less than about 5%. The diluted pulp is removed from the impregnation zone or stage 12 via line 14 to a press 16 where it is concentrated to provide high consistency pulp stock (preferably about 30–50%) in an aqueous organic solvent medium which pass via line 18 to the ozone stage or Z stage generally indicated at 20 and into which ozone is introduced as indicated at 21. The pulp carried in the aqueous organic solvent medium reacts with the ozone within the ozone reactor 20 (Z stage) to form a bleached pulp which leaves the reactor via line 22 and is fed to a solvent stripper 24 (see U.S. application Ser. No. 08/056,496 referred to above which is incorporated here by reference for further details on the preferred impregnation and bleaching stages).

The pulp in the stripper 24 is heated via steam introduced adjacent to the bottom of the stripper 24 as indicated at 26 and flows in counter-current to the flow of pulp which as above indicated will be at a consistency of about 30 to 50%. The steam adds sufficient heat to the pulp and aqueous solvent medium in the stripper 24 to evaporate a significant amount preferably substantially all of the organic solvent from the aqueous organic solvent medium surrounding the pulp.

The pulp leaves the stripper 24 as indicated at 28 while the vapors (predominantly the organic solvent and some steam) leave the stripper 24 via line 30 and are condensed in condenser 32 cooled via cooling water introduced at 34 and removed as indicated at 36. The condensed organic solvent is carried through line 38 and returned by pump 40 and lines 42 and 44 to the impregnation stage 12.

As above indicated, the concentration of the impregnated pulp and line 14 is increased by the press 16 which squeezes the excess aqueous organic solvent medium from the pulp which as indicated by line 46 passes into a tank or the like 48. Some of the excess medium from tank 48 is returned to the impregnation stage 12 via pump 50 and lines 52 and 44 and the remainder of the extracted or excess medium is directed via line 54 to a distillation column 56 which may be any suitable distillation device such as a packed or tray type tower.

Steam as indicated at 58 is fed to the bottom of the column 56 and passes in counter-current to separate from the excess aqueous solvent medium to preferentially evaporate the solvent. The evaporated solvent (plus some steam) is carried via line 60 to the cooler 62 where it is cooled by cooling water entering at 64 and removed at 66 to condense the vapors.

The condensed organic solvent leaves the cooler 62, via line 68 and is fed together with the condensed organic solvent from condenser 32 to pump 40 for recirculation back to the impregnation stage 12 as above described.

The unders or rejects from the distillation column 56 leave the system via line 70.

The system of the present invention permits efficient separation and condensation of the organic solvent such as methanol or ethanol used as the aqueous organic solvent medium in the ozone bleaching stage 20 (Z stage) for reuse in the system. However, it will apparent that some of the organic solvent is lost and makeup must be added to the system as indicated at 72.

Figure 2:
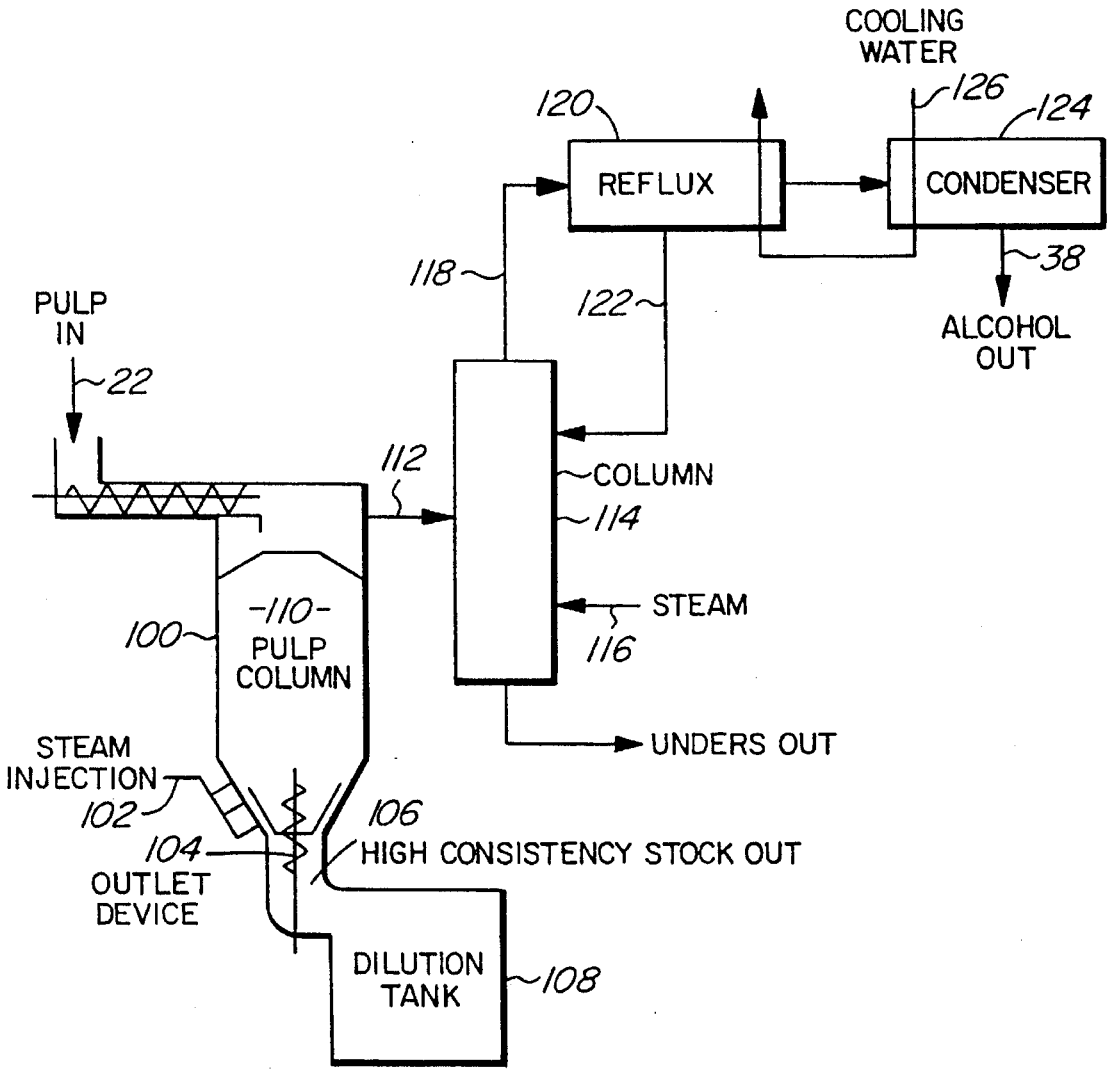
FIG. 2 is a schematic representation of one form of stripper system with a separate reflux system for use in the invention.
Figure 3:
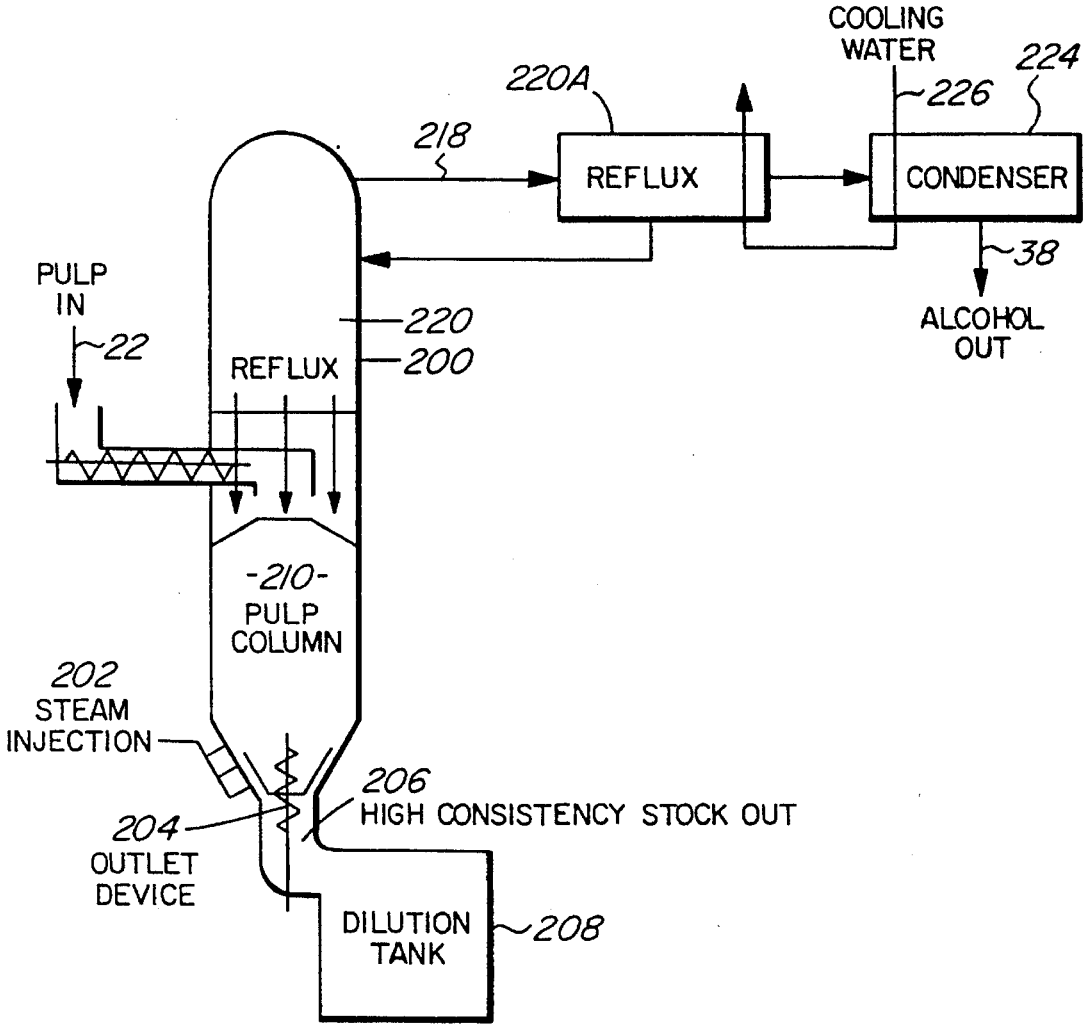
FIG. 3 is a schematic illustration of another form of stripper system for use in the present invention wherein the rectification and stripping operations occur in the same vessel.

The solvent stripper 24 used with the present invention may take any suitable form, two examples, are schematically shown in FIGS. 2 and 3 respectively.

In the arrangement shown in FIG. 2, pulp enters the stripper system via line 22 and forms a pulp column 110 of high consistency pulp stock in the chamber or vessel 100. Steam is introduced at 102 at the base of the column 110 of high consistency pulp stock, passes in counter-current to the pulp in column 110 and preferentially evaporates the solvent (which obviously has a lower boiling point then the water in the medium) to thereby separate the solvent. The pulp from which the solvent has been extracted is removed from vessel 100 by the extractor or outlet device 104, and exits as indicated on 106 into a dilution tank 108 where it is diluted (with water) for further processing.

The steam injected at 102 passes up through the pulp column 110 contained within the vessel 100 and evaporates the organic solvent which is carried from the chamber 100 via line 112 into a separating or stripping column 114 that may be a packed tower or tray tower or the like and into which more steam is introduced at the bottom as indicated at 116 to aid separation of the organic solvent from the remainder of the liquor or vapor carried over in line 112. The separated vapour containing primarily organic solvent vapour is carried via line 118 and refluxed as indicated at 120 via return line 122.

Cooling water is circulated through the reflux chamber and the condensing chamber 124 as indicated by the line 126. The condensed higher concentration organic solvent liquid condensed in chamber 124 leaves the condenser 124 and passes as above described via line 38 to be returned to the impregnation stage 12.

In the arrangement shown in FIG. 3, the pulp in line 22 enters a combined stripping and rectification tower 200 and forms a column 210 into the bottom of which is injected steam as indicated at 202. The pulp after extraction of the solvent is removed from the bottom of the column 210 in the vessel 200 via extractor 204 as indicated at 206 and is fed to a dilution tank 208 where it is diluted (with water) to the required consistency for further processing.

The vapors leaving the pulp column 210, i.e. the steam and evaporated organic solvents pass into a reflux portion 220 of the tower or vessel 200 wherein the organic solvent is reflux and the separated refluxed solvent is carried via line 218 to the cooling and reflux system 220A and eventually into a condenser 224 where the vapors containing the organic solvent are condensed via cooling water which is applied to the condenser 224 and reflux. 220 as indicated by line 226.

The condensed organic solvent (alcohol preferably ethanol or methanol) leaves the condenser 224 via line 38 to be recirculated back to the impregnation stage 12 above described.

In some cases, depending on the condition, i.e. pH of the pulp, it may be desirable to adjust the pH, e.g. to reduce the acidity of the pulp to aid in preventing degradation, e.g. by acid hydrolysis before the operation to strip the organic solvent therefrom.

It is preferred to operate a neutralization stage between the ozone stage to increase the pH of the pulp by caustic addition as schematically indicated by the arrow 23 in FIG. 1 before it is fed to the stripper. The pH of the pulp should be neutral or slightly caustic, i.e. should have a pH in the range of about 6 to 10 when it is subjected to steam stripping stage to protect the pulp against acid hydrolysis, more preferably the pH should be increased to about 7 and 9 for introduction into the stripping stage.

It is believed that acid hydrolysis may also be significantly reduced by operating the stripping stage at a relatively low temperature and high vacuum so that the acid hydrolysis rate is very small.

EXAMPLE 1

Figure 4:
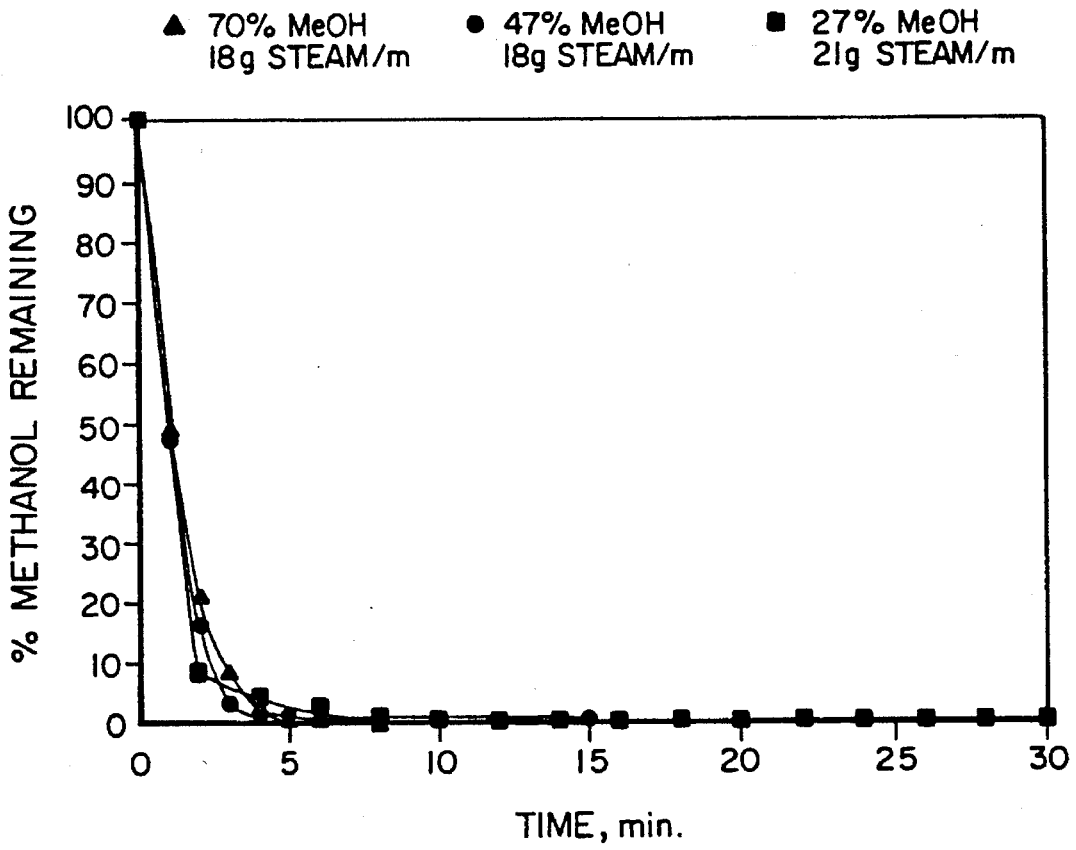
FIG. 4 is a graph of percent methanol remaining in the pulp versus time for different methanol and water concentrations in the pulp and different steam rates.

The feasibility of the present invention was tested using 54 gram samples of pulp at a consistencies in the range of 40–42% and containing various percentages of methanol in water by placing them into a 4 inch diameter column having a screen at the bottom, passing steam through the column of pulp and measuring the amount of methanol removed from the pulp at selected time intervals as indicated in FIG. 4.

The 54 gram samples of pulp each formed a column of approximately 1 foot height. The methanol in water concentrations in the pulp samples tested were 27% methanol in water indicated in FIG. 4 by the solid squares, 47% methanol in water indicated by the solid circles and 70% methanol indicated by the solid triangles. The steam flow was 21 grams of steam per minute for the 27% methanol pulp samples and 18 grams of steam per minute for the 47% methanol sample and 70% methanol sample.

As shown in FIG. 4, in all cases, the longest retention time required to reach substantially 0% residual methanol in the pulp sample was less than 10 minutes, thereby indicating that a practical process for separating methanol directly from the pulp is commercially viable.

EXAMPLE 2

Laboratory tests were done by passing steam at a selected flow rate of 13 to 14 grams per minute of steam through a pulp column sample (54 grams in weight and 12 inches in height) containing 47% methanol (36.1 ml or 28.5 grams) for the sample. The initial pulp consistency was 41.3% and the final pulp consistency was 39%.

Temperature measured at the center of the column of pulp near the top column stabilized after about 4 to 4½ minutes at a temperature of 99° C.

Table 1 shows measured amounts based on samples taken at the indicated time segments. It will be noted that after about 5 minutes, the methanol left in the pulp was down to 1.8% of the total methanol that is contained in the original pulp sample and after 15 minutes, there was absolutely nothing left.

It will be apparent that with no reflux, full stripping may be obtained at a reasonable cost and reasonable period of time.

TABLE 1

| Time min | Off Gas Conden-sate Vol, ml | MeOH in Off Gas Conc % vol | MeOH ml | MeOH Remaining in Pulp % |
|---|---|---|---|---|
| 1 | 23 | 69.0 | 15.9 | 59.4 |
| 2 | 23 | 54.1 | 12.4 | 27.8 |
| 3 | 19 | 33.1 | 6.3 | 11.7 |
| 4 | 16.5 | 17.0 | 2.8 | 4.6 |
| 5 | 15.5 | 7.0 | 1.1 | 1.8 |
| 6 | 15 | 1.9 | 0.3 | 1.0 |
| 8 | 30 | 0.80 | 0.2 | 0.5 |
| 10 | 29 | 0.44 | 0.1 | 0.2 |
| 15 | 75.5 | 0.12 | 0.2 | 0 |
| 20 | 77 | <0.1 | — | 0 |

EXAMPLE 3

The heat or steam required to reduce the amount of alcohol in the off-going pulp was calculated for incoming pulps containing 30% or 40% methanol at a pulp consistency of about 50%.

Table 2 shows the calculated values of the amounts of heat required based on different percent alcohols in the alcohol water leaving the system, i.e. unrecovered alcohol concentration for a given residual methanol concentration in the pulp leaving the system.

TABLE 2

| Feed Pulp % alc | Pulp Out ppm alc | Concentration of Recovered Alcohol % alc | Heat Required (steam) btu/lb feed |
|---|---|---|---|
| 30 | 200 | 97 | 45,293.69 |
| 30 | 200 | 95 | 42,297.31 |
| 30 | 200 | 90 | 678.44 |
| 30 | 200 | 85 | 367.78 |
| 30 | 200 | 75 | 317.88 |
| 30 | 200 | 70 | 317.17 |
| 40 | 200 | 94 | 30,341.40 |
| 40 | 200 | 95 | 37,379.07 |
| 40 | 200 | 90 | 1,030.13 |
| 40 | 200 | 85 | 561.71 |
| 40 | 200 | 75 | 348.40 |
| 40 | 200 | 70 | 332.56 |

It can be seen that by adjusting the steam flow relative to the pulp, effective removal of the methanol from the pulp may be obtained at a reasonable cost in terms of btu/lb.

EXAMPLE 4

Ozonation was performed at the optimal pH in the range of about 2 to 3 using methanol and water as the medium during the ozone stage to produce a pulp having a viscosity of 21.5 cp. When the pulp was fed directly to a methanol stripping stage, its viscosity after stripping dropped to 10.8 cp. Similarly, its brightness dropped dramatically from 60% ISO after the ozonation stage to 47.7% ISO after the methanol recovery stage, i.e. stripping stage. When this pulp was further subjected to an oxygen peroxide extraction stage followed by a further ozone stage and then a peroxide stage, i.e. the complete sequence of a $Z_mSE_{op}ZP$ sequence where $Z_m$=an ozone stage using a methanol water medium S=a stripping or methanol recovery stage $E_{op}$=an alkaline extraction stage using oxygen and peroxide in an extraction liquor Z=a conventional ozone stage and P=a peroxide stage.

A pulp having a brightness of 88.2% ISO and a viscosity of 8.9 cp was obtained.

When the pH of this same ozonated pulp was adjusted to about a pH of 9 by the addition of caustic (NaOH) and then subjected to the stripping or methanol recovery stage, the viscosity of the pulp after methanol stripping was 22.4 cp, i.e. an increase of approximately 1 cp from that after the $Z_m$ stage and the brightness decreased only to 56% ISO.

The above results were obtained by neutralizing the ozonated pulp at about 25% consistency as this was the consistency at which reasonable mixing could be obtained. To improve the uniformity of the pulp, another sample of the ozonated pulp was further diluted to 20% consistency and then neutralized to the pH of about 9 with caustic. This neutralized pulp had a viscosity of 23.3 cp after the methanol recovery stage. When the above procedure, i.e. $Z_m$NS (where N is a neutralization stage) was combined with an $E_{op}$ stage, the pulp obtained had a brightness of 85.3 ISO and viscosity of 17.8 which compares very well with the standard $Z_mE_{op}$ (without methanol recovery) which had a brightness of a 84.8 ISO and a viscosity of 18.3 cp.

The disclosure has been directed primarily to a bleaching process and the separation of the organic solvent from the bleached pulp and the water of the aqueous medium surrounding the chips during the bleaching operation which is the preferred application of the inventors. It will be apparent that other operations wherein separation of such solvent from pulp and water is desirable, the stripping operation described above may be employed.

Having described the invention, modifications will be evident to those skilled in the art without departing from the scope of the invention as defined in the appended claims.

We claim:

1. A process for bleaching pulp in an aqueous organic solvent and recovering solvent comprising impregnating said pulp with an aqueous organic solvent medium in an impregnation stage to form an impregnated pulp, bleaching said impregnated pulp with ozone in an ozone bleaching stage at a pH of less than 6 to form a bleached pulp, adding caustic to said bleached pulp in said aqueous medium containing said solvent in a neutralization stage so that the pH of said bleached pulp is raised to at least neutralize said bleached pulp and then feeding said bleached pulp to a stripping vessel, heating said bleached pulp in said aqueous medium in said stripping vessel to evaporate said solvent and separate said solvent from said medium and said pulp to provide a separated organic solvent liquor and said pulp in a medium substantially free of said organic solvent.

2. A process as defined in claim 1 wherein the pH of said bleached pulp in said aqueous organic medium is adjusted in said neutralizing stage to range of 6 to 10.

3. A process as defined in claim 2 further comprising returning said separated organic solvent liquor to said impregnation stage.

4. A process as defined in claim 3 further comprising further concentrating said separated organic liquor before it is returned to said impregnation stage.

5. A process as defined in claim 1 wherein the pH of said bleached pulp in said aqueous organic medium is adjusted in said neutralizing stage to a range of 7 to 9.

6. A process as defined in claim 5 further comprising returning said separated organic solvent liquor to said impregnation stage.

7. A process as defined in claim 6 further comprising further concentrating said separated organic liquors before it is returned to said impregnation stage.

8. A process as defined in claim 1 further comprising returning said separated organic solvent liquor to said impregnation stage.

9. A process as defined in claim 8 further comprising further concentrating said separated organic liquor before it is returned to said impregnation stage.

10. A method as defined in claim 8 wherein said impregnation stage includes diluting said pulp in said aqueous organic solvent medium, separating excess of said medium diluting said pulp in said impregnation stage to provide recovered excess organic medium and returning said recovered excess organic medium to said impregnation stage.

* * * * *